US005775686A

United States Patent [19]

Miyake

[11] Patent Number: 5,775,686

[45] Date of Patent: Jul. 7, 1998

[54] SHEET FEEDING DEVICE WITH LIFTER MEMBER TO HOLD SHEETS AT PREDETERMINED HEIGHT

[75] Inventor: Hiroaki Miyake, Kawaguchi, Japan

[73] Assignee: Canon Kabushiki Kaisha, Tokyo, Japan

[21] Appl. No.: 648,884

[22] Filed: May 16, 1996

[30] Foreign Application Priority Data

May 22, 1995 [JP] Japan ..... 7-122322

[51] Int. Cl.[6] ..... B65H 1/08; B65H 1/22

[52] U.S. Cl. ..... 271/127; 271/157; 271/164

[58] Field of Search ..... 271/157, 126, 271/127, 160, 162, 164

[56] References Cited

U.S. PATENT DOCUMENTS 4,234,305 11/1980 Miyake et al. .

5,228,676 7/1993 Arai et al. ..... 271/157 X

FOREIGN PATENT DOCUMENTS 92480 4/1994 Japan ..... 271/157

*Primary Examiner*—Boris Milef

*Attorney, Agent, or Firm*—Fitzpatrick, Cella, Harper & Scinto

[57] ABSTRACT

The invention provides a sheet feeding device in which a lifter member of a lifter unit for maintaining the level of the topmost sheet of the sheets loaded in a sheet holding unit at a substantially constant height is made movable along the direction of removal of the sheet holding unit in order to move the moving lifter away from the sheet holding unit if the lifter being released downward gets caught by the sheet holding unit being removed, thus allowing reliable removal of the sheet holding unit.

17 Claims, 6 Drawing Sheets

SHEET FEEDING DEVICE WITH LIFTER MEMBER TO HOLD SHEETS AT PREDETERMINED HEIGHT

BACKGROUND OF THE INVENTION

1. Field of the Invention

The present invention relates to a sheet feeding device that may be used, for example, in an image forming apparatus.

2. Description of the Related Art

Conventional image forming apparatuses such as copying machines are generally provided with a sheet feeding device which feeds sheets, loaded in a feed cassette or the like, by sheet feeding means such as a feed roller. In some conventional sheet feeding devices the sheet feed cassette is capable of holding sheets is mounted to the apparatus body and a lifter mechanism is provided to raise and lower the sheet loading plate disposed within the cassette to maintain the height of the surface of the top sheet at a substantially constant height, so as to allow effective sheet feeding by the feed roller.

A description will hereunder be given of a conventional mechanical lifter mechanism, with reference to FIGS. 7 and 8. Referring to FIG. 7, the driving force of a motor M of the sheet feeding device is transmitted to a liftup gear 18, causing a liftup cam 19 formed integrally with the liftup gear 18 to rotate in the direction of arrow a of the figure. The liftup cam 19 is an eccentric cam. When a contacting section 20*c* of a feed pawl 20 comes into contact with the eccentric cam section or the liftup cam 19, a ratchet gear 17 engaging a gear engaging section 20*b* of the feed pawl 20 rotates in the direction of arrow b of the figure, thus upwardly rotating a lifter 16 (see FIG. 8) integrally formed with the ratchet gear 17.

A lock pawl 22 engaging the ratchet gear 17 prevents the ratchet gear 17 from rotating in a direction opposite to the direction of arrow b. This causes the gear engaging section 20*b* to rotate the ratchet gear 17 forward one tooth at a time, allowing the lifter 16 to be rotated upward. The feed pawl 20 is biased by a spring 50 such that the gear engaging section 20*b* always engages the ratchet gear 17. The lock pawl 22 is biased by a spring 51 such that it always engages the ratchet gear 17.

Means for releasing the lifter mechanism include those which actuate the release mechanism when the operator operates the grip of the sheet cassette 1 and those which actuate the release mechanism upon removal of the cassette 1. In an example of the latter case, in accordance with the removing operation of the cassette 1 the lock pawl 22 is disengaged from the ratchet gear 17, which results in rotation of the lifter 16 in a direction opposite to the direction of arrow b due to the weight of the sheets or the weight of the lifter 16, itself, thus releasing the lifter. This method, however, has the following problem. Referring to FIG. 8, when, in order to replenish the cassette 1 with paper sheets, the cassette 1 is removed too rapidly, the cassette 1 gets caught by the lifter 16 because the lifter 16 blocks the removal. This results in scraping of the lifter 16 and the cassette 1, making it difficult to remove the cassette 1.

Solutions have been proposed to overcome this problem. For example, as illustrated in FIG. 8, an opening 1*a* of the cassette 1, opposing the lifter 16, may be made to move far away from the lifter 16 or the lifter 16 may be provided with a spring 52 that biases the lifter 16 downwards, so that the cassette 1 can be removed easily.

However, the aforementioned proposed solutions do not completely overcome the problem.

More specifically, when a cassette 1 capable of holding a large quantity of sheets is used, it takes a relatively long time for the lifter 16 to be released sufficiently downwards. In such a case, the opening 1*a* of the cassette 1, opposing the lifter 16, can be made even larger, or the spring 52 used to bias the lifter 26 downwards can be made stronger. However, a larger opening reduces the strength of the cassette 1, and a stronger spring makes it necessary for the upwardly rotating lifter 16 to overcome the force of the spring 52 and lift up a larger quantity of paper sheets, so that the motor or solenoid becomes larger, the construction becomes complicated, etc., resulting in a larger device.

In addition, in the mechanical lifter mechanism, the feed pawl 20 is moved in accordance with the rotation of the eccentric cam 19 in order to rotate the lifter 16 upward via the ratchet gear 17, so that, for example, when the main switch of the image forming apparatus is suddenly turned off, the feed pawl 20 and the eccentric cam 19 may stop at an improper position. Accordingly, even when an attempt is made to release the lifter 16, the eccentric cam 19 prevents the feed pawl 20 from being disengaged from the ratchet gear 17. Therefore, the user may have difficulty handling the cassette 1 because the cassette 1 cannot be removed until the main switch is turned on again.

SUMMARY OF THE INVENTION

Accordingly, an object of the present invention is to provide a sheet feeding device which makes it possible to eliminate the problem of scraping of the lifter and sheet holding container, without having to decrease the strength of the sheet holding container and increase the size of the device, to achieve easier handling of the sheet holding container, and to allow removal of the sheet holding container even when the main switch is suddenly turned off.

In one aspect, there is provided:

sheet holding means for holding a stack of sheets, the sheet holding means removably mounted to the device body;

sheet feeding means for feeding sheets held by the sheet holding means;

lifter means provided at the device body for supporting the sheet stack such that the topmost sheet of the sheet stack held by the sheet holding means is held at a predetermined height; and a lifter member provided in the lifter means to lift up the sheets held by the sheet holding means;

wherein the lifter member is movably supported to allow movement of the lifter member in the direction of removal of the sheet holding means from the device body.

By virtue of the above-described construction, when the lifter member moves in the direction of removal of the sheet holding means it will be released downward even when the lifter member gets caught by the sheet holding means before it has been released completely downward during removal of the sheet holding means, thereby allowing removal of the sheet holding means and preventing damage to the sheet holding means, lifter member, etc.

In another aspect, the present invention provides for:

sheet holding means for holding a stack of sheets, the sheet holding means removably mounted to the device body;

sheet feeding means for feeding sheets held by the sheet holding means;

lifter means provided at the device body for supporting the sheet stack such that the topmost sheet of the sheet stack held by the sheet holding means is held at a predetermined height;

a lifter member provided in the lifter means to lift up the sheets held by the sheet holding means; and drive transmission means for driving the lifter member, wherein the lifter member is movably supported to allow movement in the direction of removal of the sheet holding means from the device body, the movement of the lifter member in the direction of removal of the sheet holding means terminating drive transmission linkage of the drive transmission means.

By virtue of the above-described construction, even when the removal of the sheet holding means does not cause the lifter member to be released downward because the main switch for some reason has been turned off and the drive transmission linkage of the drive transmission means in the lifter means has not been terminated, it is possible to release the lifter member downward by moving the lifter member in the direction of removal to thereby terminate the drive transmission linkage, thereby making it possible to remove the sheet holding means in any state of the lifter member.

In still yet another aspect of the present invention, the above-described sheet feeding devices may be provided as integral parts of image forming devices, wherein the sheet is fed to an image forming means for forming an image on the sheet.

DESCRIPTION OF PREFERRED EMBODIMENT

Figure 1:
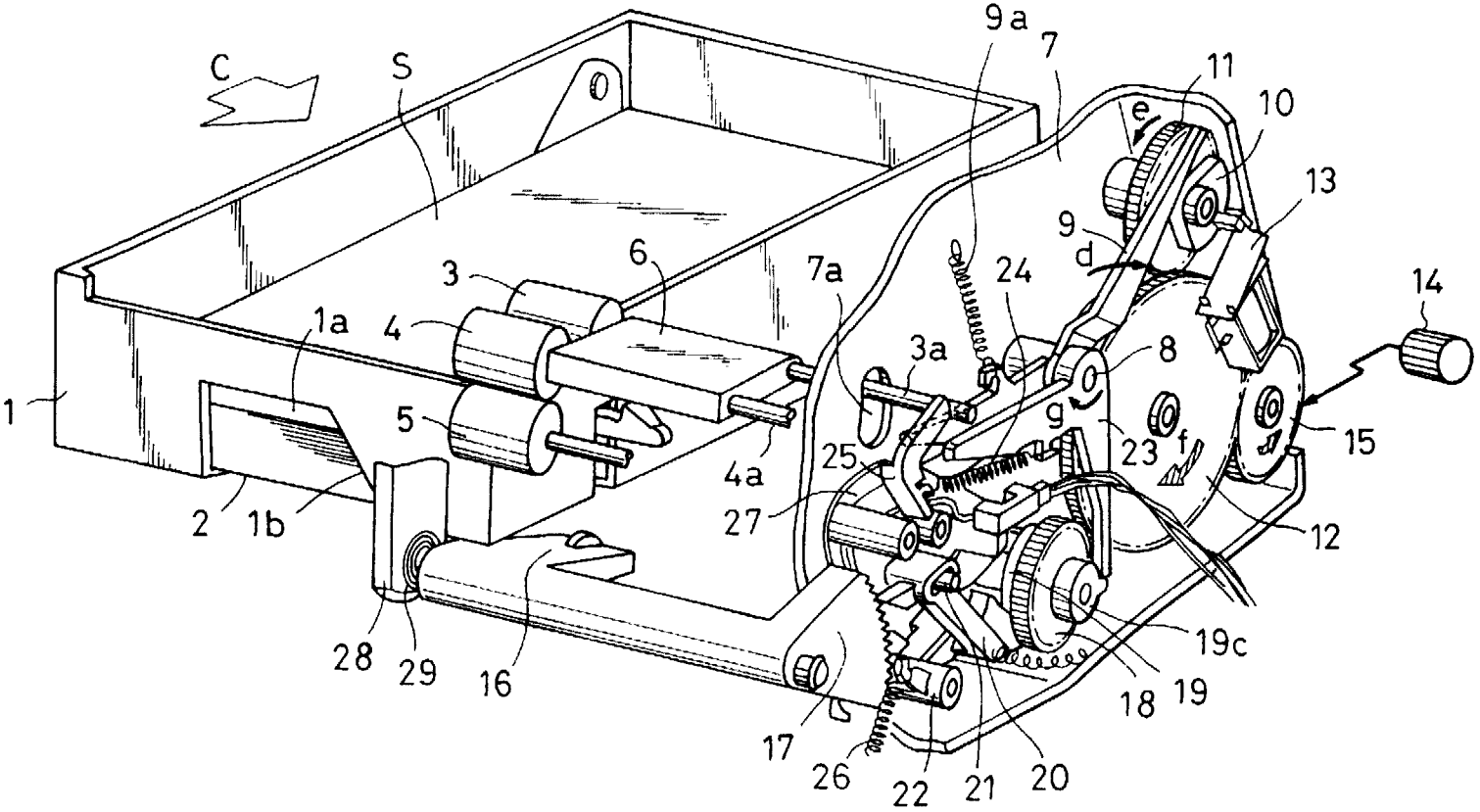
FIG. 1 is a perspective view of the entire construction of a sheet feeding device of the present invention.
Figure 2A:
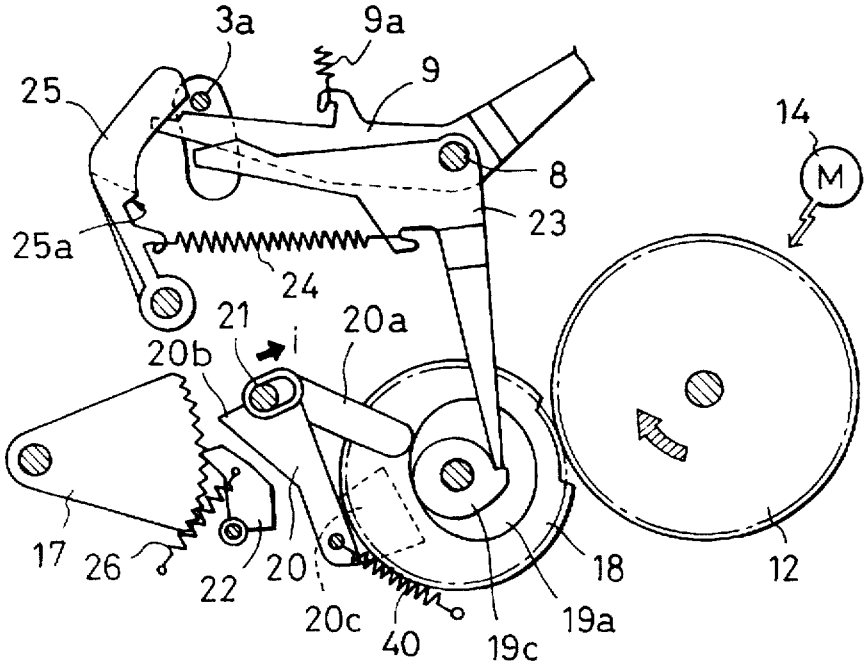
FIGS. 2(*a*) and 2(*b*) are cross-sections illustrative of the lift-up operation of a lifter.
Figure 2B:
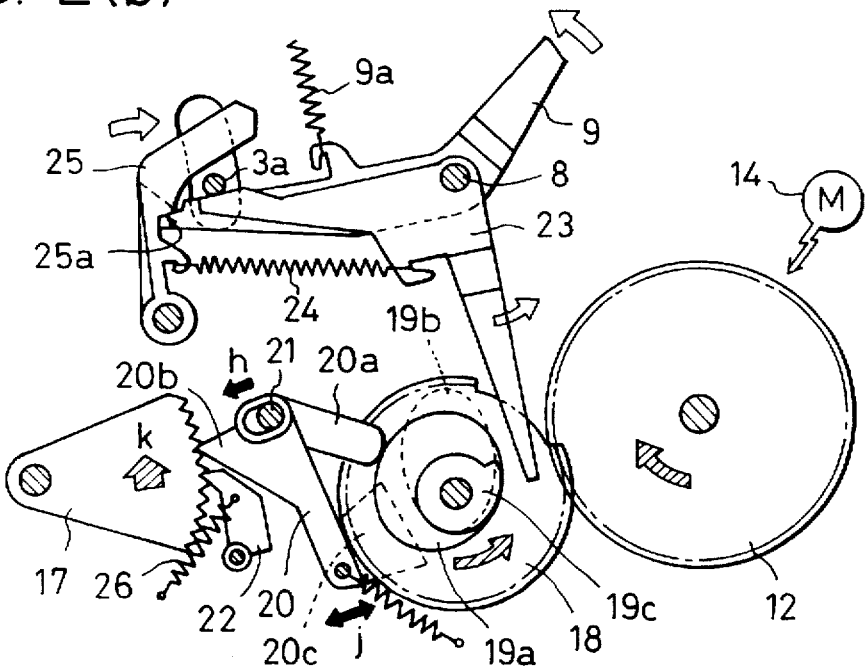
Figure 3A:
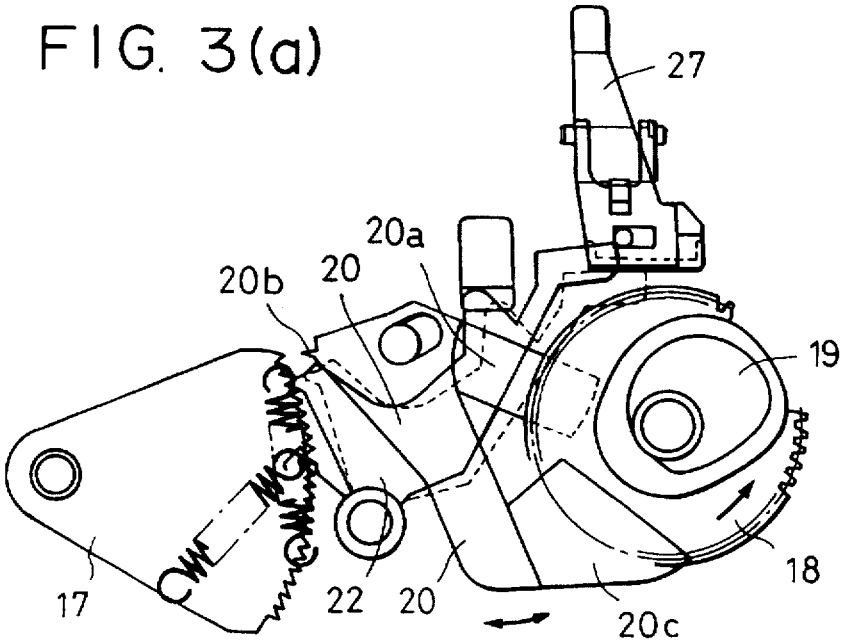
FIGS. 3(*a*) and 3(*b*) are cross-sections illustrative of a mechanical lifter mechanism.
Figure 3B:
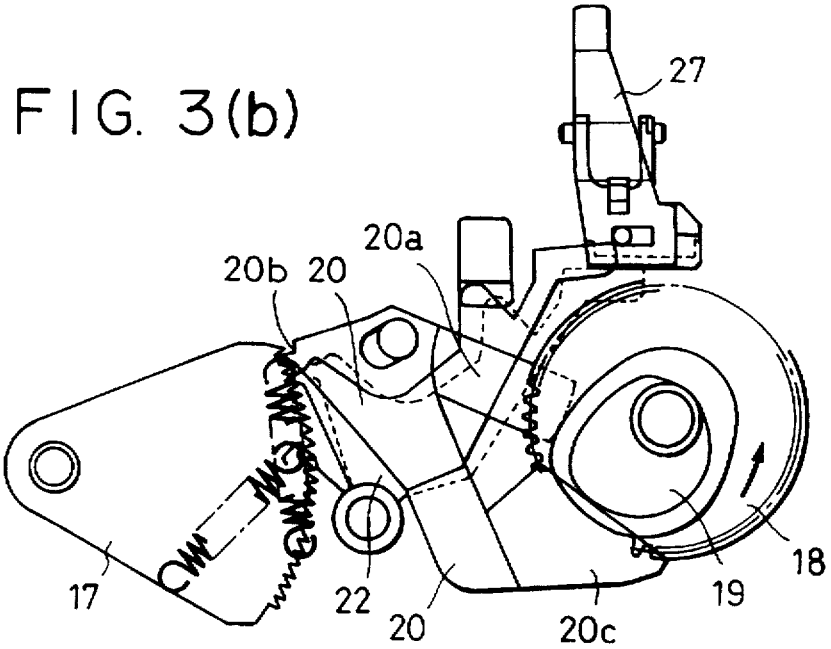
Figure 4A:
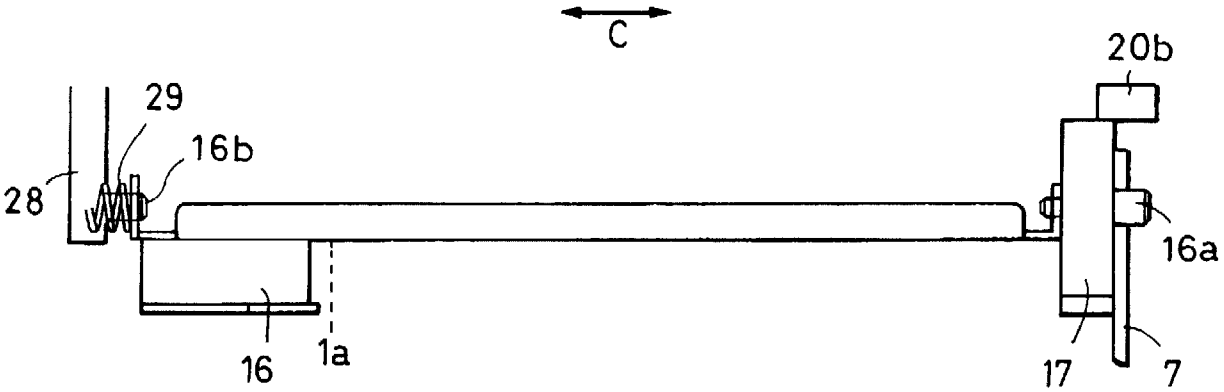
FIGS. 4(*a*) and 4(*b*) are views illustrating the movement of the lifter section.
Figure 4B:
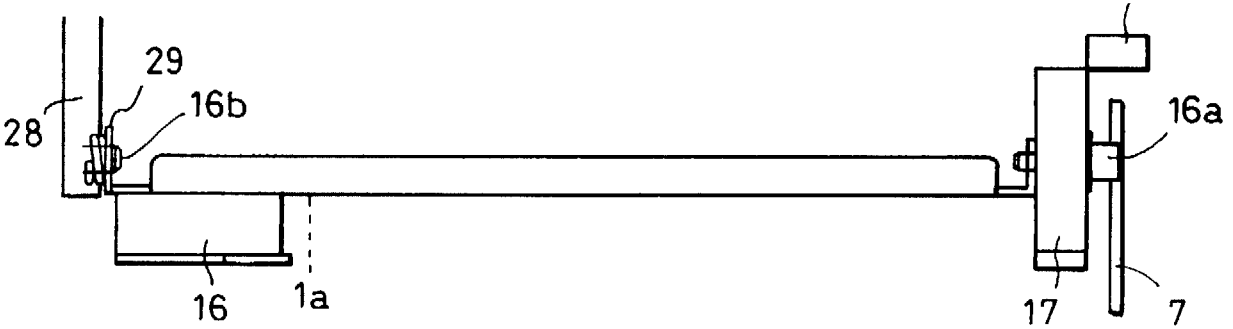
Figure 5:
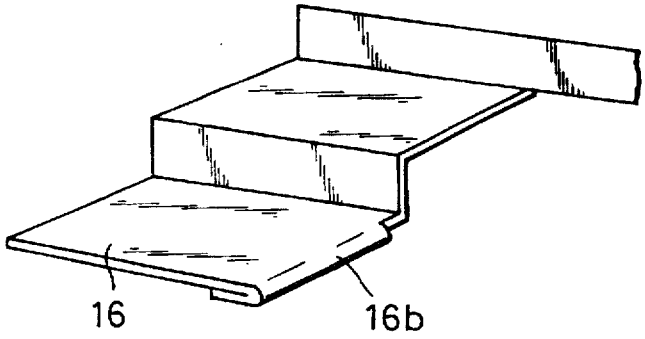
FIG. 5 is a perspective view of a portion of a lifter section.
Figure 6:
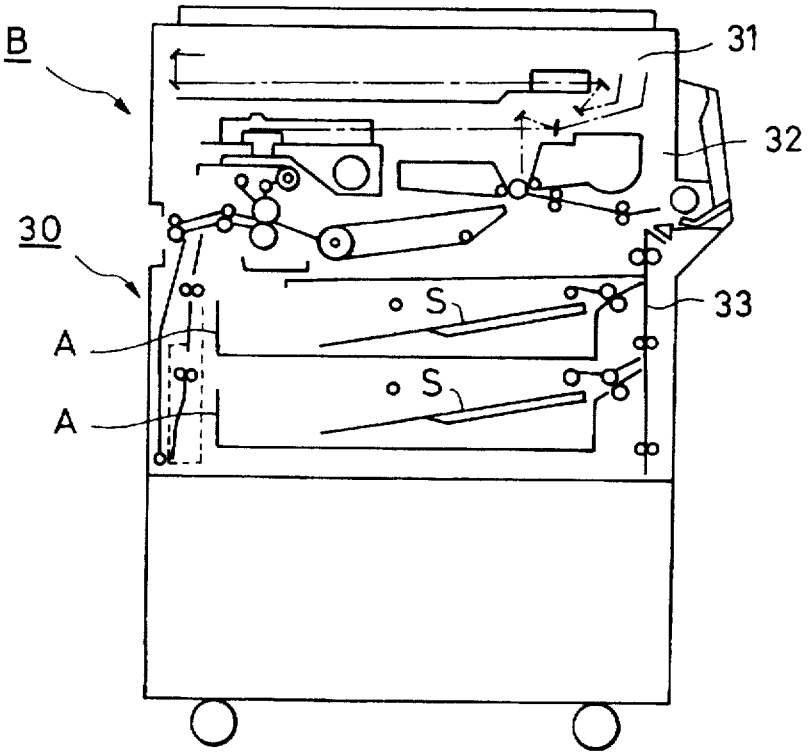
FIG. 6 is a cross-section illustrative of the construction of an image forming apparatus utilizing the sheet feeding device of the present invention.
Figure 7:
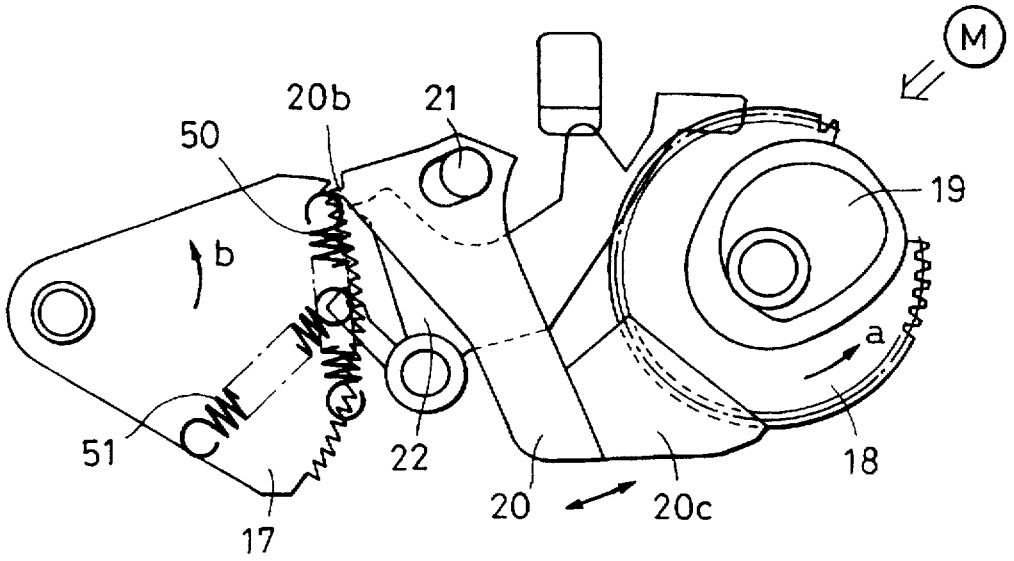
FIG. 7 PRIOR ART
FIG. 7 is an illustration for describing a conventional lifter mechanism.
Figure 8:
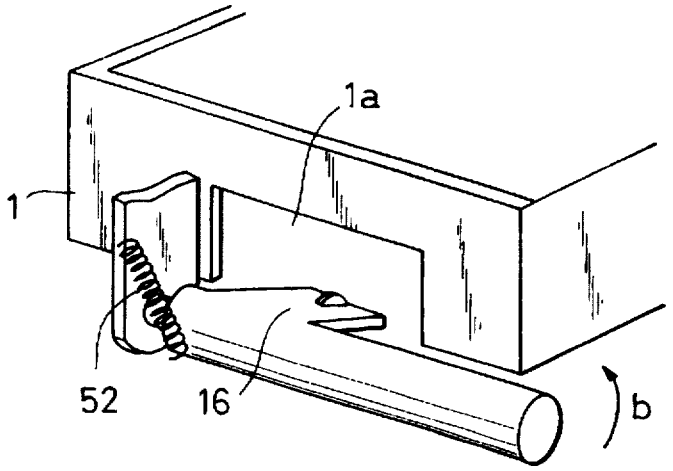
FIG. 8 PRIOR ART
FIG. 8 is an illustration for describing the conventional lifter mechanism.

A description will now be given of an image forming apparatus and a sheet feeding device of an embodiment of the present invention, with reference to the drawings. FIG. 1 is a perspective view of the entire construction of a sheet feeding device of the present invention. FIGS. 2(*a*) and 2(*b*) are illustrative of the lift-up operation of a lifter. FIGS. 3(*a*) and 3(*b*) are illustrative of a mechanical lifter mechanism. FIGS. 4(*a*) and 4(*b*) are illustrative of the movement of a lifter section. FIG. 5 is a perspective view of the critical portion of the lifter section. FIG. 6 is illustrative of the construction of an image forming apparatus utilizing the sheet feeding device of the present invention. It is to be noted that the invention is described in the case where a paper sheet is used, although sheets made of synthetic resin or the like may also be used.

Referring now to FIG. 1, reference numeral 1 denotes a sheet cassette used as a sheet holding container. Sheet S is loaded onto a sheet loading plate 2 which is rotatably mounted at the bottom of the cassette 1. The cassette 1 is constructed such that it is mountable to the feeder body in the direction of arrow c of FIG. 1.

Reference numeral 3 denotes a pickup roller used as a rotating member for delivering the sheets S loaded on the cassette 1 from the uppermost side of the cassette 1. Reference numeral 4 denotes a feed roller and reference numeral 5 denotes a retard roller, which are rotatingly driven forwardly and reversely, respectively, with respect to the sheet transporting direction, in order to separate and feed the sheets S one sheet at a time. A pickup roller shaft 3*a* of the pickup roller 3 and a feed roller shaft 4*a* of the feed roller 4 are operatively linked and supported by a roller holder 6. The pickup roller 3 is supported such that it can turn independent of the feed roller 4.

One end of the pickup roller shaft 3*a* passes through a slot 7*a* formed in a sheet feed frame 7 and extends to a lifter mechanism (at the right side of FIG. 1). A liftup lever 9 is rotatably mounted to a shaft 8 integrally formed with the sheet feed frame 7 and is biased clockwise in the direction of arrow d of FIG. 1 by a spring 9*a*. This causes one end of the liftup lever 9 to be in contact with the pickup roller shaft 3*a*. The other end of the liftup lever 9 extends up to the region adjacent to a pickup cam 10 which rotates to cause rotation of the liftup lever 9.

The pickup cam 10 is formed coaxially and integrally with a side face of a pickup gear 11 which is partly not toothed and opposes a gear 12. The pickup gear 11 is biased counterclockwise in the direction of arrow e of FIG. 1 by biasing means (not shown). In the present embodiment, the rotation of the pickup cam 10 is stopped by a solenoid 13 of the flapper type that opposes the biasing means. Reference numeral 14 denotes a main motor of the image forming apparatus body. The driving force from the motor 14 is transmitted to the gear 12 via a gear 15, causing the gear 12 to always rotate in the direction of arrow f of FIG. 1.

A description will now be given of the mechanical lifter mechanism. Reference numeral 16 denotes a lifter for raising and lowering the sheet loading plate 2 mounted at the bottom of the cassette 1. A ratchet gear 17 is formed integrally with the lifter 16. A liftup gear 18 which is partly not toothed and opposes the gear 12 has a liftup cam 19 coaxially formed thereto. The rotation of the liftup cam 19 causes a feed pawl 20 to move with respect to a shaft 21 and a lock pawl 22 which prevents reverse movement of the ratchet gear 17 to allow the ratchet gear 17 to move forwardly one tooth at a time, thereby upwardly rotating the lifter 16 (see FIG. 2(*b*)). This lifts up the sheets S in the cassette 1.

In FIG. 1, reference numeral 23 denotes a lifter trigger lever which is rotatably supported on the shaft 8 integrally formed with the sheet feed frame 7 and is biased clockwise in the direction of arrow g of FIG. 1 by a spring 24. One end of the lifter trigger lever 23 engages a stopper section 19*c* to stop the rotation of the liftup gear 18 formed integral with the liftup cam 19. The other end of the lever 23 is disposed such that it contacts the pickup roller shaft 3*a* when the pickup roller 3 moves down to a predetermined height.

More specifically, when the pickup roller shaft 3*a* moves down to a predetermined height, the lifter trigger lever 23 disengages the lifter trigger lever 23 engaging the stopper section 19*c*, which allows free rotation of the liftup cam 19. When this causes the feed pawl 20 to be shifted by a mechanism to be described later, the lifter 16 rotates upward. When the topmost sheet of the sheet stack S is lifted upward due to the upward rotation of the lifter 16, the pickup roller 3 in contact with the topmost sheet S moves upward. This causes the lifter trigger lever 23 to rotate clockwise in the direction of arrow g of FIG. 1 and return to its original position, thus stopping the rotation of the liftup cam 19 once again. These operations are repeated to maintain the height of the topmost sheet of the sheet stack S in the cassette 1 at a substantially constant level.

A description will now be given of the liftup operation started when the lifter 16 has not yet been upwardly rotated, with reference to FIGS. 2(*a*) and 2(*b*). Upon one rotation of the pickup cam 10 with the arrangement illustrated in FIG. 2(*a*), a pawl section 25*a* of a pickup lock lever 25 is retained by one end of the liftup lever 9. As a result, the lifter trigger lever 23 is disengaged from the stopper section 19*c*, allowing free rotation of the liftup cam 19. The liftup cam 19 rotates integrally with the liftup gear 18 due to the engagement of the liftup gear 18 and the gear 12. Upon rotation of the liftup cam 19, the lifter mechanism operates to raise and lower the paper sheets, which is described below.

The liftup cam 19 has first cam 19*a* and second cam 19*a* coaxially disposed. The first cam 19*a* is an eccentric cam which is formed such that it can contact a first cam contact section 20*a* of the feed pawl 20. The feed pawl 20 is rotatably mounted about the shaft 21 as center in a mounting slot and can move in the direction of arrow h of FIG. 2(*b*) or in direction of arrow i of FIG. 2(*a*), depending on the height of the first cam 19*a*. Rotation of the liftup cam 19 causes rotation of the first cam 19*a* to permit the ratchet gear 17 and the gear engaging section 20*b* of the feed pawl 20 to contact with and separate from each other.

As illustrated in FIG. 2(*a*), the feed pawl 20 is moved in the i direction by a spring 40, so that the ratchet gear 17 and the gear engaging section 20*b* of the feed pawl 20 are not engaged with each other when ordinary liftup operation does not need to be performed. As illustrated in FIG. 2(*b*), the rotation of the liftup gear 18 causes the ratchet gear 17 and the gear engaging section 20*b* of the feed pawl 20 to be in engagement, in accordance with the rotation of the first cam 19*a*.

The second cam 19*a* represented by the broken lines of FIG. 2(*b*) comes into contact with a second cam contacting section 20*c* of the feed pawl 20, causing the feed pawl 20 to move in the directions of double-headed arrow j of FIG. 2(*b*) to upwardly rotate the ratchet gear 17 in the direction of arrow k of FIG. 2(*b*). When the ratchet gear moves in the direction of arrow k, the lock pawl 22 is momentarily disengaged from the ratchet gear and is then pulled by a spring 26 to engage with the tooth of the ratchet directly below the one it had been engaging with, thereby stopping the rotation of the ratchet gear 17.

When the lifter 16 lifts up the sheets S and the top sheet S moves up the pickup roller 3, the pickup roller shaft 3*a* rotates the pickup lock lever 25 counterclockwise (in FIG. 2(*a*)), moving the pawl section 25*a* away from the liftup lever 9 by which it was retained. When this occurs, the rotation of the liftup cam 19 is again stopped by the end of lifter trigger lever 23 which engages the stopper section 19*c*. The gear engaging section 20*b* of the feed pawl 20 and the ratchet gear 17 are disengaged. These operations are repeated to upwardly rotate the lifter 16 to the proper level.

To sum up the above-described liftup operations: (1) the liftup gear 18 rotates, (2) the feed pawl 20 and the ratchet gear 17 engage each other (refer to arrow h of FIG. 2(*b*)), (3) the ratchet gear 17 is rotated upward (refer to arrows j, k of FIG. 2(*b*)), (4) the lock pawl 22 engages the tooth directly below the one it had been engaging, and (5) the feed pawl 20 and the ratchet gear 17 disengage from each other (refer to arrow i of FIG. 2(*a*)).

A description will now be given of releasing the lifter, with reference to FIG. 3(*a*). As mentioned above, the ratchet gear 17 ordinarily retains only the lock pawl 22. When the cassette 1 is removed, a protrusion of the cassette 1 (not shown) pushes the protruding portion of the lock pawl 22, which is caught by a cassette lock spring 27 and secured as represented by the broken lines in the figure. Consequently, the ratchet gear 17 no longer retains any pawls, causing the lifter 16 to be released and drop downward by virtue of its own weight.

A description will now be given of the features of the present invention, with reference to FIGS. 1 and 4. The ratchet gear end is supported by a lifter shaft 16*a* secured to the frame 7 and the lifter 16 end is supported by a lifter shaft 16*b* secured to a lifter supporting member 28, with both ends being rotatably supported. A compression spring 29 being an elastic member is provided between the lifter supporting member 28 and the lifter 16. The lifter 16 is constructed such that the expansion or contraction of the compression spring 29 allows it to move in the direction the cassette 1 is inserted and removed (indicated by arrow c in the figure). The amount of movement of the lifter 16 is set no more than is necessary to allow the ratchet gear 17 to disengage from the gear engaging section 20*b* of the feed pawl 20.

The lifter shaft 16*a* at the frame 7 end is formed long enough to allow it to remain secured to the frame 7 even when the lifter 16 moves toward the lifter supporting member 28. Accordingly, in releasing the lifter 16 in accordance with the removal of the cassette 1, even when the cassette 1 is rapidly removed and the lifter 16 and the edge of an opening 1*a* of the cassette 1 come into contact with each other, the compression spring 29 is momentarily contracted to move the lifter 16 to the lifter supporting member 28 end as illustrated in FIG. 4(*b*). Therefore, the cassette 1 does not get caught by the lifter 16, which has conventionally been a problem when handling the cassette 1.

For easier handling of the cassette 1, the edge of the opening 1*a* of the cassette 1 may have a tapered portion 1*b* or a spring which biases the lifter 16 downward may be provided. The face where the lifter 16 and the edge of the opening 1*a* of the cassette 1 bump into each other may be made smoother and formed into an R surface, thereby making it possible to prevent both the lifter 16 and the edge of the opening 1*a* from being scraped. In this case, as shown for example in FIG. 5, the side of the lifter 16 which comes into contact with the edge of the opening 1*a* of the cassette 1 may be formed into a bent section 16*b* to form the R face, or a different component part may be used to form the R face.

Although the present invention has been described in relation to the mechanical lifter mechanism, a lifter mechanism in which the lifter is directly actuated by a motor or the like may also be used. In addition, the lifter release construction may be such as to release the lifter in accordance with the movement of the grip of cassette 1 or in accordance with the removal of the cassette 1.

By virtue of the above-described construction, it is possible to eliminate the problem of scraping of the lifter 16 and the cassette 1 even when the cassette is removed rapidly and thus it is possible to achieve easier handling of the cassette 1, without having to sacrifice the strength and increasing the size of the cassette 1.

A description will now be given of the removability of the cassette 1 when the main switch is suddenly turned off during use of the mechanical lifter mechanism. As illustrated in FIG. 3(*b*), the feed pawl 20 is retained by the ratchet gear 17 by the liftup cams 19*a*, 19*a*, when the lifter 16 is being rotated upward.

In this case, when the main switch of the image forming apparatus body is suddenly turned off, the lifter 16 is released. The lifter release operation only disengages the lock pawl 22, disengaged, as mentioned above, so that the feed pawl 20 remains engaged. Therefore, when only the lock pawl 22 is disengaged, the lifter 16 cannot be released, so that the cassette 1 cannot be removed.

Since the lifter 16 made movable in the direction of removal of the cassette 1, when the user removes the cassette 1 and an inner wall 1*a* of the cassette 1 and the lifter 16 bump into each other, the ratchet gear 17 either integrally positioned with the lifter 16 or positioned by screwing or the like moves in the same direction as the lifter 16, as illustrated in FIG. 4(*b*), causing the gear engaging section 20*b* of the feed pawl 20 and the ratchet gear 17 to disengage from each other. Consequently, there are no component parts which engage the lifter 16, which allows the lifter 16 to be released Therefore, the above-described construction allows the cassette 1 to be removed even when the main switch of the image forming apparatus body is suddenly turned off.

In the present invention, the construction of the mechanical lifter mechanism is not limited to the present embodiment and the present embodiment does not necessarily have to be used. For example, means for upwardly rotating the lifter 16 by means of gears may be used instead of the lifter mechanism employing the ratchet gear 17 and the feed pawl 20.

By virtue of the foregoing construction, it is possible to mount and remove the cassette 1 even when the lifter 16 and means for upwardly rotating the lifter 16 are in engagement after the main switch of the image forming apparatus body is suddenly turned off.

Any component part may be used for the elastic member as long as it extends and contracts uniformly, although the compression spring 29 was used as the elastic member in the present embodiment. Examples of elastic members include those made of rubber, air dampers, etc.

Although in the present embodiment, the compression spring 29 used as an elastic member was placed between the lifter shaft 16*a* and the lifter supporting member 28 so as to allow the lifter 16 to move in the direction the cassette 1 is mounted and removed, the lifter supporting member 28, itself, can also be made the elastic member in another embodiment.

A description will now be given of the image forming apparatus utilizing the above-described sheet feeding device, with specific reference to FIG. 6.

The image forming apparatus of FIG. 6 includes a copying machine B with sheet feeding devices A, an optical scanning system 31 at the topmost portion of a vertical-type apparatus body 30, and an image forming section functioning as recording means disposed below the optical scanning system 31. The aforementioned sheet feeding devices A are disposed at the lower portion of the apparatus body 30, with the sheets S fed from the sheet feeding device A being transported to the image forming section 32 through a transporting section 33 which is a predetermined path for transporting the sheets S.

The sheets S are transported from the sheet feeding device A to the image forming section 32 via the transporting section 33 in synchronism with the reading of the original by the optical scanning system 31 to allow an image to be formed on the sheet S at the image forming section 32.

When the image forming apparatus is constructed utilizing the sheet feeding device with the above-described construction, it is possible to eliminate the problem of scraping of the lifter and the sheet holding container, without having to reduce the strength of the sheet holding container and increasing the size of the apparatus, to achieve easier handling of the sheet holding container, as well as to allow removal of the sheet holding container even when the main switch is suddenly turned off.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet feeding device comprising:

a device body;

sheet holding means for holding a stack of sheets, said sheet holding means removably mounted to the device body;

sheet feeding means for feeding sheets held by said sheet holding means;

lifter means provided at said device body for supporting the sheet stack such that the topmost sheet of the sheet stack held by said sheet holding means is held at a predetermined height;

a lifter member provided in said lifter means to lift in an upward direction the sheet stack held by said sheet holding means; and lifter member support means for movably supporting said lifter member to allow movement of said lifter member in the direction of removal of said sheet holding means from said device body, wherein said lifter member support means has a biasing means for biasing said lifter member in a direction of mounting of said sheet holding means.

2. A sheet feeding device according to claim 1, wherein said lifter member has a shaft supported by said lifter member support means and a lifter portion provided by said shaft, said biasing means is an elastic member provided in said shaft and the elastic member biases said lifter member in a direction of mounting of said sheet holding means.

3. A sheet feeding device according to claim 1 or claim 2, wherein said lifter member is rotatably supported, whereby rotation of said lifter member pushes up the sheets held by said sheet holding means from below the sheets.

4. A sheet feeding device according to claim 1, wherein said sheet holding means is mountable to said device body from a direction perpendicular to the direction of sheet feeding by said sheet feeding means.

5. A sheet feeding device according to claim 4, wherein said lifter member is rotatably supported and reciprocatingly movable along the direction of removal of said sheet holding means by lifter shafts disposed at both ends thereof as viewed in the direction of feeding by said sheet feeding means.

6. A sheet feeding device according to claim 5, wherein said lifter member rotates into an opening formed at the forward end as viewed in the sheet feeding direction of the outer frame of said sheet holding means, thereby contacting a lower surface of a loading plate provided in said sheet holding means to hold the sheets and thus lifting up the sheets.

7. A sheet feeding device according to claim 6, wherein an edge of said opening is tapered.

8. A sheet feeding device according to claim 5 or claim 6, wherein said lifter means includes a feed pawl which rotates upon being rotatably driven, said feed pawl engaging and rotating a ratchet gear connected to said lifter member to lift up the sheets.

9. A sheet feeding device according to claim 8, wherein a lock pawl engaging said ratchet gear is provided to stop said ratchet gear from rotating in a direction opposite to the direction by which the sheets are lifted up by said lifter member, and wherein disengagement of said lock pawl from said ratchet gear in connection with removal of said sheet holding means from said device body terminates the sheet lifting operation of said lifter member.

10. A sheet feeding device according to claim 8, wherein when said lifter member moves in the direction of removal of said sheet holding means, said ratchet gear and said feed pawl disengage from each other.

11. A sheet feeding device according to claim 1, wherein said sheet feeding means has a pickup roller, said pickup roller contacting the surface of the topmost sheet of the sheets held by said sheet holding means at the predetermined height.

12. A sheet feeding device comprising:

a device body;

sheet holding means for holding a stack of sheets, said sheet holding means removably mounted to the device body;

sheet feeding means for feeding sheets held by said sheet holding means;

lifter means provided at said device body for supporting the sheet stack such that the topmost sheet of the sheet stack held by said sheet holding means is held at a predetermined height;

a lifter member provided in said lifter means to lift in an upward direction the sheet stack held by said sheet holding means;

lifter member support means for movably supporting said lifter member to allow movement of said lifter member in the direction of removal of said sheet holding means from said device body;

biasing means provided on said lifter member support means for biasing said lifter member in a direction of mounting of said sheet holding means; and drive transmission means for transmitting drive to said lifter member;

wherein the drive transmitted by said drive transmission means is interrupted when said lifter member moves in the direction of removal of said sheet holding means against a biasing force of said biasing means.

13. A sheet feeding device according to claim 12, wherein said lifter member is rotatably supported, and said drive transmission means is disengaged as a result of movement of said lifter member in the direction of removal of said holding means.

14. A sheet feeding device according to claim 13, wherein said lifter means includes a feed pawl which rotates upon being rotatably driven, said feed pawl engaging and rotating a ratchet gear connected to said lifter member to lift up the sheets as said lifter member is rotated, the movement of said lifter member in the direction of removal of said sheet holding means causing disengagement of said ratchet gear and said feed pawl.

15. A sheet feeding device according to claim 14, wherein a lock pawl which engages said ratchet gear is provided to stop said ratchet gear from rotating in a direction opposite to the direction by which the sheets are lifted up by said lifter member, the sheet lifting operation of said lifter member being terminated by disengagement of said lock pawl from said ratchet gear as a result of removal of said sheet holding means from said device body.

16. An image forming apparatus comprising:

an image forming apparatus body;

sheet holding means for holding a stack of sheets, said sheet holding means removably mounted to the image forming apparatus body;

sheet feeding means for feeding sheets held by said sheet holding means;

lifter means provided at said image forming apparatus body for supporting the sheet stack such that the topmost sheet of the sheet stack held by said sheet holding means is held at a predetermined height;

a lifter member provided in said lifter means to lift in an upward direction the sheet stack held by said sheet holding means;

image forming means for forming an image on the sheet fed from said sheet feeding means; and lifter member support means for movably supporting said lifter member to allow movement of said lifter member in the direction of removal of said sheet holding means from said image forming apparatus body, wherein said lifter member support means has a biasing means for biasing said lifter member in a direction of mounting of said sheet holding means.

17. An image forming apparatus comprising:

an image forming apparatus body;

sheet holding means for holding a stack of sheets, said sheet holding means removably mounted to the image forming apparatus body;

sheet feeding means for feeding sheets held by said sheet holding means;

lifter means provided at said image forming apparatus body for supporting the sheet stack such that the topmost sheet of the sheet stack held by said sheet holding means is held at a predetermined height;

a lifter member provided in said lifter means to lift in a upward direction the sheet stack held by said sheet holding means;

lifter member support means for movably supporting said lifter member to allow movement of said lifter member in the direction of removal of said sheet holding means from said image forming apparatus body;

biasing means provided on said lifter member support means for biasing said lifter member in a direction of mounting of said sheet holding means;

drive transmissions means for transmitting drive to said lifter member; and image forming means for forming an image of the sheet fed from said sheet feeding means, wherein the drive transmitted by said drive transmission mean is interrupted when said lifter member moves in the direction of removal of said sheet holding means against a biasing force of said biasing means.

* * * * *

UNITED STATES PATENT AND TRADEMARK OFFICE

CERTIFICATE OF CORRECTION

PATENT NO. : 5,775,686

DATED : July 7, 1998

INVENTOR : HIROAKI MIYAKE

It is certified that error appears in the above-identified patent and that said Letters Patent is hereby corrected as shown below:

COLUMN 5

Line 21, "19a" (second occurrence) should read --19b--; and
Line 41, "19a" should read --19b--.

COLUMN 10

Line 54, "transmissions" should read --transmission--.

Signed and Sealed this

Ninth Day of March, 1999

*Attest:*

*Attesting Officer*

Q. TODD DICKINSON

*Acting Commissioner of Patents and Trademarks*